US006358017B1

(12) United States Patent
Ota et al.

(10) Patent No.: US 6,358,017 B1
(45) Date of Patent: Mar. 19, 2002

(54) CONTROL VALVE FOR VARIABLE DISPLACEMENT COMPRESSOR

(75) Inventors: Masaki Ota; Tomoji Tarutani; Ken Suitou; Ryo Matsubara, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/651,032

(22) Filed: Aug. 30, 2000

(30) Foreign Application Priority Data

Aug. 31, 1999 (JP) ..... 11-245574

(51) Int. Cl.[7] ..... F04B 1/26
(52) U.S. Cl. ..... 417/222.2
(58) Field of Search ..... 417/222.2, 269, 417/213, 270

(56) References Cited

U.S. PATENT DOCUMENTS 4,606,705 A 8/1986 Parekh
5,145,326 A * 9/1992 Kimura et al. ..... 417/222.2
5,702,235 A 12/1997 Hirota et al.
5,890,876 A * 4/1999 Suito et al. ..... 417/213
5,964,578 A * 10/1999 Suitou et al. ..... 417/222.2
6,010,312 A * 1/2000 Suitou et al. ..... 417/222.2
6,062,823 A * 5/2000 Kawaguchi et al. ..... 417/222.2
6,062,824 A * 5/2000 Kimura et al. ..... 417/222.2
6,213,727 B1 * 4/2001 Kawaguchi ..... 417/222.2

FOREIGN PATENT DOCUMENTS

JP 5-099136 4/1993

* cited by examiner

*Primary Examiner*—Teresa Walberg
*Assistant Examiner*—Vinod D. Patel
(74) *Attorney, Agent, or Firm*—Morgan & Finnegan, LLP

(57) ABSTRACT

A variable displacement compressor includes a bleed passage for releasing gas from a crank chamber to a suction chamber and a supply passage for supplying gas from a discharge chamber to the crank chamber. A control valve includes an outlet valve mechanism located in the bleed passage and an inlet valve mechanism located in the supply passage. When the inlet valve mechanism is in the open state, the outlet valve mechanism is in the closed state. An outlet valve body of the outlet valve mechanism has a communication passage. When the outlet valve mechanism is in the closed state, the communication passage is opened to communicate the crank chamber with the suction chamber. Therefore, when the compressor is operating at the minimum displacement, a gas circuit is positively formed within the compressor, and atomized lubricant in refrigerant gas positively lubricates the moving parts of the compressor.

17 Claims, 6 Drawing Sheets

CONTROL VALVE FOR VARIABLE DISPLACEMENT COMPRESSOR

BACKGROUND OF THE INVENTION

The present invention relates to a control valve used in a variable displacement compressor, more specifically, to control valve that adjusts the pressure in a crank chamber to control the displacement of a compressor.

In a typical variable displacement compressor, the inclination angle of a swash plate varies according to the pressure in a crank chamber (crank pressure) to change the displacement of the compressor. There are two methods to control the crank pressure: the inlet control method and the outlet control method. The inlet control method is a method in which gas is constantly released from the crank chamber to a compressor suction chamber at a fixed flow rate, and the flow rate of gas drawn into the crank chamber from a compressor discharge chamber is adjusted to control the crank pressure. The outlet control method is a method in which highly pressurized gas is constantly supplied to the crank chamber at a fixed flow rate, and the flow rate of gas released from the crank chamber to the discharge chamber is adjusted to control the crank pressure.

The inlet control method permits the crank pressure to quickly increase, which improves the response of the compressor. However, to maintain the crank pressure, the flow rate of highly pressurized gas flowing into the crank chamber must correspond to that of gas flowing out of the crank chamber. In other words, a relatively great amount of highly pressurized gas is required to maintain the crank pressure. The outlet control method, on the other hand, is advantageous in that little highly pressurized gas is required to maintain the crank pressure. However, the outlet control method cannot quickly increase the crank pressure and therefore does not improve the compressor response. Therefore, a compound control valve, which has the advantages of both inlet and outlet control mechanisms, has been introduced. For example, Japanese Unexamined Patent Publication No. 5-99136 discloses such a compound control valve.

The control valve disclosed in the publication has a first valve body and a substantially annular second valve body. The first valve body selectively opens and closes a supply passage, which connects a discharge chamber to a crank chamber. The second valve body selectively opens and closes a bleed passage, which connects the crank chamber to a suction chamber. The first and second valve bodies are actuated by a common transmission rod. The rod is electromagnetically moved by a solenoid to actuate the valve bodies. The solenoid urges the rod by a force that corresponds to the value of a supplied current. The rod slidably extends through the second valve body. The control valve also includes a diaphragm. The diaphragm actuates the second valve body according to the suction pressure of the compressor.

The first valve body and the second valve body are not actuated at the same time. That is, the first valve hole and the second valve hole are not opened at the same time. During a normal displacement control procedure, the diaphragm receives the force of the solenoid through the rod and actuates the second valve body in accordance with the suction pressure to adjust the opening degree of the bleed passage. In this state, the first valve body closes the supply passage. However, when the compressor displacement needs to be quickly decreased, the value of current supplied to the solenoid is maximized to maximize the force of the solenoid.

This causes the second valve body to close the bleed passage and permits the rod to move the first valve body to open the supply passage. As a result, the crank pressure quickly increases, which quickly decreases the compressor displacement.

In the field of variable displacement compressors for vehicles, clutchless compressors are becoming standard. A clutchless compressor is directly coupled to a vehicle engine. Clutchless compressors are advantageous in reducing weight and cost.

When a compressor is operating, gas circulates within the compressor. Atomized oil in the gas lubricates the moving parts of the compressor. A compressor with a clutch can be disconnected from the engine by disengaging the clutch when refrigeration is not needed. The compressor is stopped accordingly. In this state, the moving parts of the compressor require no lubrication.

A clutchless compressor continues operating as long as the engine runs even if refrigeration is not needed. When refrigerant is not needed, the compressor is operated at the minimum displacement to reduce the load on the engine. During the minimum displacement operation, the moving parts must be lubricated. Therefore, a compressor in which gas circulates during the minimum displacement operation has been proposed. Such a compressor has a gas circuit, in which gas circulates through a discharge chamber, a crank chamber, a suction chamber, cylinder bores and a discharge chamber.

Publication No. 5-99136 discloses a control valve used in a compressor having a clutch. If the control valve of the publication is used in a clutchless compressor, gas cannot be circulated in the compressor during the minimum displacement operation. That is, when the compressor is operating at the minimum displacement, the second valve body closes the bleed passage and the first valve body opens the supply passage. Therefore, although gas flow from the discharge chamber to the crank chamber through the supply passage is permitted, gas does not flow from the crank chamber to the suction chamber through the bleed passage. Thus, a gas circuit is not formed within the compressor. The second valve body may temporarily open the bleed passage in accordance with a change of the suction pressure. However, the first and second valve bodies do not simultaneously open. Thus, gas only occasionally circulates within the compressor.

An auxiliary passage, which is independent from the bleed passage in which the control valve is located, may be formed in the compressor housing to connect the crank chamber to the suction chamber. The auxiliary passage would permit gas to circulate within the compressor during the minimum displacement operation. However, the auxiliary passage would undermine one of the advantages of the control valve of the publication. That is, the auxiliary passage limits the ability to quickly increase the pressure of the crank chamber. Also, forming the auxiliary passage complicates the manufacture.

SUMMARY OF THE INVENTION

Accordingly, it is an objective of the present invention to provide a displacement control valve that includes an inlet valve mechanism and an outlet valve mechanism and easily forms a gas circuit within a compressor.

To achieve the foregoing and other objectives and in accordance with the purpose of the present invention, a control valve for a variable displacement compressor is provided. The displacement of the compressor varies in accordance with the pressure in a crank chamber. The compressor includes a suction pressure zone, the pressure of which is a suction pressure, a discharge pressure zone, the pressure of which is a discharge pressure, a bleed passage for releasing gas from the crank chamber to the suction pressure zone, and a supply passage for supplying gas from the discharge pressure zone to the crank chamber. The control valve includes an outlet valve mechanism, an inlet valve mechanism, a transmission member, an electromagnetic actuator and a communication passage. The outlet valve mechanism is located in the bleed passage to adjust the opening degree of the bleed passage. The inlet valve mechanism is located in the supply passage to adjust the opening degree of the supply passage. The transmission member extends between the outlet valve mechanism and the inlet valve mechanism to couple the outlet valve mechanism with the inlet valve mechanism. The transmission member moves axially. When the inlet valve mechanism is in an open state, the outlet valve mechanism is in a closed state. The electromagnetic actuator axially urges the transmission member by a force, the magnitude of which corresponds to the value of a current supplied to the actuator. The communication passage is formed in the outlet valve mechanism. When the outlet valve mechanism is in the closed state, the communication passage may be opened, depending on the axial position of the transmission member, for communicating the crank chamber with the suction pressure zone.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
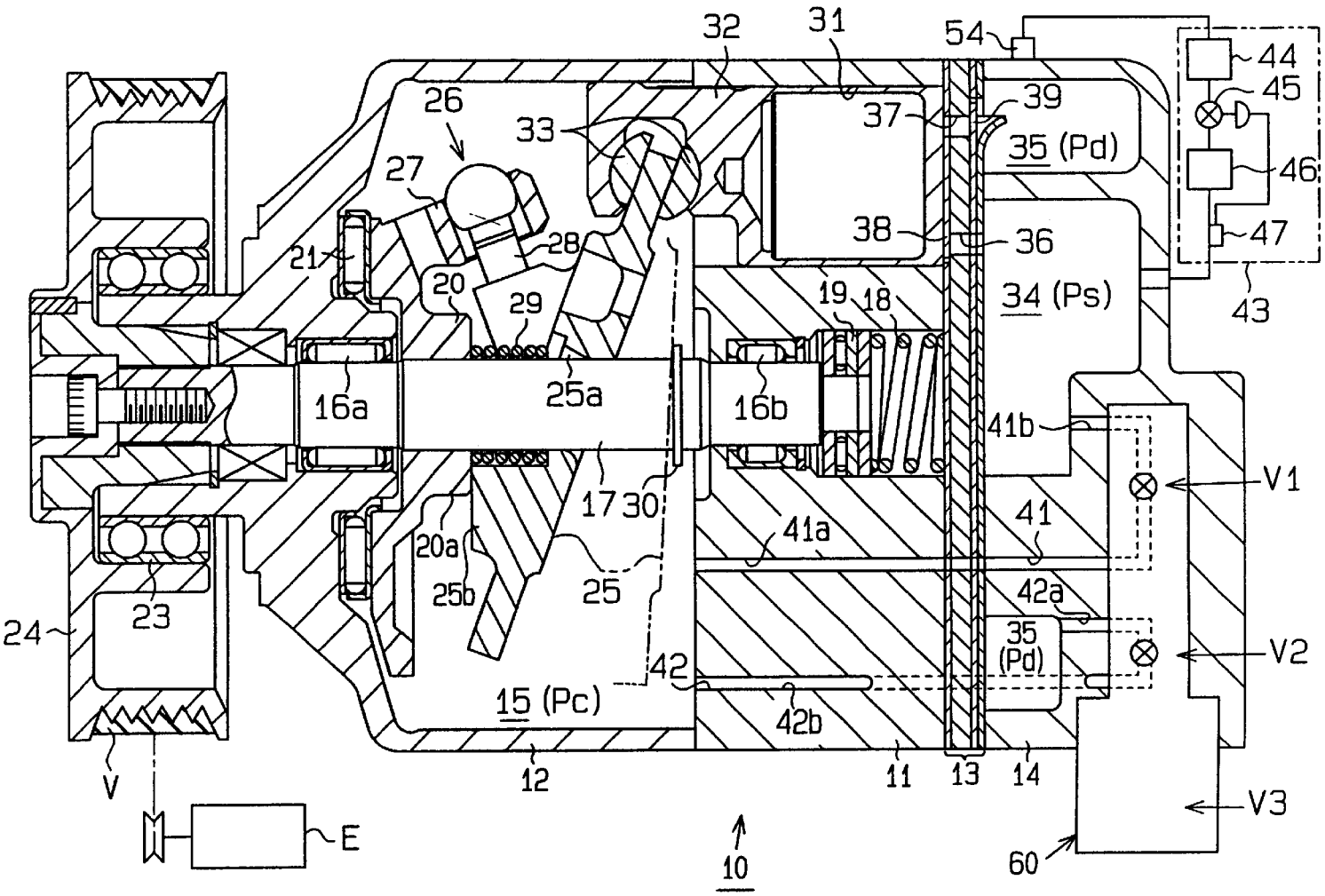
FIG. 1 is a cross-sectional view illustrating a variable displacement compressor according to a first embodiment of the present invention.

A first embodiment of the present invention will now be described with reference to FIGS. 1 to 5. As shown in FIG. 1, a vehicle variable displacement swash plate type compressor 10 has a housing. The housing includes a cylinder block 11, a front housing member 12, a valve plate assembly 13 and a rear housing member 14. The front housing member 12 is secured to the front end face of the cylinder block 11. The rear housing member 14 is secured to the rear end face of the cylinder block 11. The valve plate assembly 13 is located between the cylinder block 11 and the rear housing member 14. The cylinder block 11 and the front housing member 12 define a crank chamber 15. In FIG. 1, the left end of the compressor is defined as the front end, and the right end of the compressor is defined as the rear end.

A drive shaft 17 extends through the crank chamber 15 and is supported through radial bearings 16*a*, 16*b* by the front housing member 12 and the cylinder block 11. A recess is formed in the center of the cylinder block 11. A spring 18 and a rear thrust bearing 19 are located in the recess.

A lug plate 20 is secured to the drive shaft 17 in the crank chamber 15. A front thrust bearing 21 is located between the lug plate 20 and the inner wall of the front housing member 12. The rear thrust bearing 19 and the front thrust bearing 21 support the drive shaft 17 in the axial direction.

The front housing member 12 has a cylindrical wall at its front end. A pulley 24 is supported by the cylindrical wall with an angular bearing 23. The pulley 24 is coupled to the front end of the drive shaft 17. The pulley 24 is coupled to an external drive source, which is a vehicle engine E in this embodiment, by a belt V.

A swash plate 25 is accommodated in the crank chamber 15. The swash plate 25 has a hole 25*a* formed in the center. The drive shaft 17 extends through the hole 25*a*. The swash plate 25 is coupled to the lug plate 20 by a hinge mechanism 26. The hinge mechanism 26 includes two support arms 27 (only one is shown) and two guide pins 28 (only one is shown). Each support arm 27 projects from the rear side of the lug plate 20 and has a guide hole. Each guide pin 28 projects from the swash plate 25. The cooperation of the arms 27 and the guide pins 28 permits the swash plate 25 to rotate integrally with the shaft 17. The cooperation also permits the swash plate 25 to slide along and incline relative to the drive shaft 17.

A spring 29 is located between the lug plate 20 and the swash plate 25. The spring 29 urges the swash plate 25 toward the cylinder block 11. A stopper ring 30 is fixed on the drive shaft 17 behind the swash plate 25. When the swash plate 25 contacts the stopper ring 30, the swash plate 25 is at the minimum inclination, which is for example, three to five degrees. When a counter weight 25*b* of the swash plate 25 contacts a stopper 20*a* formed on the lug plate 20, the swash plate 25 is at the maximum inclination angle.

Cylinder bores 31 (only one shown) are formed in the cylinder block 11. The cylinder bores 31 are arranged about the drive shaft 17. A single headed piston 32 is accommodated in each cylinder bore 31. Each piston 32 is coupled to the swash plate 25 by a pair of shoes 33. The swash plate 25 converts rotation of the drive shaft 17 into reciprocation of the pistons 32.

A suction chamber 34, which is a suction pressure zone, and a discharge chamber 35, which is a discharge pressure zone, are defined in the rear housing member 14. The discharge chamber 35 surrounds the suction chamber 34. Suction ports 36, suction valve flaps 38, discharge ports 37 and discharge valves flap 39 are formed in the valve plate assembly 13. Each set of the ports 36, 37 and the valve flaps 38, 39 corresponds to one of the cylinder bores 31. When each piston 32 reciprocates, refrigerant gas is drawn into the associated cylinder bore 31 through the corresponding suction port 36. The refrigerant gas is then compressed the cylinder bore 31 and is discharged to the discharge chamber 35 through the corresponding discharge port 37. When each piston 32 compresses the gas in the associated cylinder bore 31, refrigerant gas in the cylinder bore 31 leaks into the crank chamber 15 between the surface of the piston 32 and the wall of the cylinder bore 31. The leaking gas is referred to as blowby gas.

A bleed passage 41 and supply passage 42 are formed in the housing of the compressor 10. The bleed passage 41 connects the crank chamber 15 to the suction chamber 34. The supply passage 42 connects the discharge chamber 35 to the crank chamber 15. A displacement control valve 60 is located in the rear housing member 14 to regulate the bleed passage 41 and the supply passage 42. A section of the bleed passage 41 between the crank chamber 15 and the control valve 60 will be referred to as an upstream bleed section 41*a,* and a section of the bleed passage between the control valve 60 and the suction chamber 34 will be referred to as a downstream bleed section 41*b.* A section of the supply passage 42 between the discharge chamber 35 and the control valve 60 will be referred to as an upstream supply section 42*a,* and a section of the supply passage 42 between the control valve 60 and the crank chamber 15 will be referred to as a downstream supply section 42*b.* The control valve 60 includes an outlet valve mechanism V1 located in the bleed passage 41, an inlet valve mechanism V2 located in the supply passage 42 and an electromagnetic solenoid V3.

An external refrigerant circuit 43 connects the discharge chamber 35 to the suction chamber 34. The compressor 10 and the external refrigerant circuit 43 form a vehicle air-conditioner refrigeration circuit. The external refrigerant circuit 43 includes a condenser 44, an expansion valve 45 and an evaporator 46. The opening degree of the expansion valve 45 is controlled based on the temperature detected by a heat sensitive tube 47 at the outlet of the evaporator 46. The expansion valve 45 supplies liquid refrigerant, the amount of which corresponds to the thermal load on the air-conditioner refrigeration circuit, to regulate the flow rate of refrigerant in the external refrigerant circuit 43. The compressor 10 has a check valve mechanism 54 located between the discharge chamber 35 and the condenser 44. The check valve mechanism 54 prevents back flow of gas from the condenser 44 to the discharge chamber 35. The check valve mechanism 54 opens to permit refrigerant gas to flow from the discharge chamber 35 to the condenser 44 based on the difference between the pressure in the discharge chamber 35 (discharge pressure Pd) and the pressure at the inlet of the condenser 44. The check valve mechanism 54 is not opened by the discharge pressure Pd when the compressor 10 is operating at the minimum displacement and thus stops gas flow from the discharge chamber 35 to the external refrigerant circuit 43.

Figure 2:
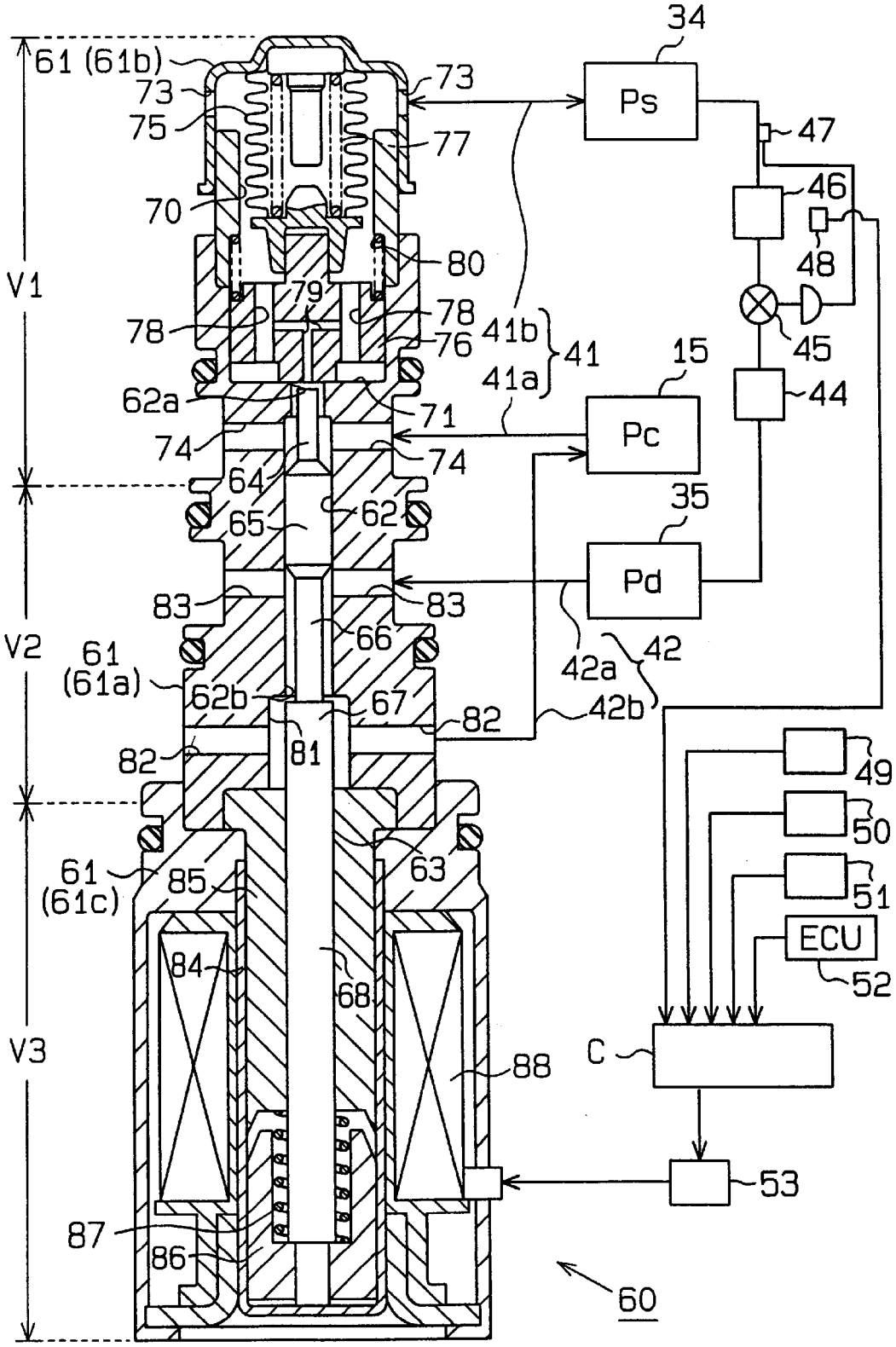
FIG. 2 is a cross-sectional view of the displacement control valve used in the compressor FIG. 1.

As shown in FIG. 2, the electromagnetic solenoid V3 of the control valve 60 is connected to a controller C, which controls the air conditioner. The controller C includes a computer. The controller C receives information of the temperature of the evaporator 46 detected by a temperature sensor 48. The controller C also receives information regarding the vehicle passenger compartment temperature detected by a compartment temperature sensor 49, information regarding a target temperature set by a compartment temperature adjuster 50, and ON/OFF sate information regarding of an air conditioner switch 51. Further, the controller C receives various information regarding the running state of the engine E from an electronic control unit (ECU) 52, which controls the engine E. The controller C controls the solenoid V3 through a drive circuit 53 based on the received information.

The control valve 60 will now be described. As shown in FIG. 2, the upper portion of the control valve 60 is the outlet valve mechanism V1. The middle portion is the inlet valve mechanism V2. The lower portion is the electromagnetic solenoid mechanism V3. The outlet valve mechanism V1 controls the flow rate of refrigerant gas released from the crank chamber 15 to the suction chamber 34 through the bleed passage 41. The inlet valve mechanism V2 controls the flow rate of highly pressurized gas supplied from the discharge chamber 35 to the crank chamber 15 through the supply passage 42. The solenoid mechanism V3 controls the outlet valve mechanism V1 and the inlet valve mechanism V2 according to commands from the controller C.

The control valve 60 includes a valve housing 61. The valve housing 61 includes an upper portion 61*a,* a cap 61*b* and a lower portion 61*c*. The cap 61*b* is secured to the upper end of the upper portion 61*a*. A through hole 62 is formed axially in the center of the upper portion 61*a*. The through hole 62 receives a transmission member, which is a transmission rod 63 in this embodiment. The rod 63 moves axially through the hole 62. The rod 63 couples the outlet valve mechanism V1 and the inlet valve mechanism V2.

The transmission rod 63 includes a distal portion 64, a separator 65, a first coupler 66, an inlet valve body 67 and a second coupler 68. The separator 65 is located in the through hole 62 to divide the through hole 62 into an upper zone and a lower zone. The diameter of the distal portion 64 and the diameter of the first coupler 66 are smaller than the inner diameter of the through hole 62. The inlet valve body 67 is moved between a position where the inlet valve body 67 enters the through hole 62 and a position where the inlet valve body 67 separates from the through hole 62. When the valve body 67 enters the through hole 62, a small annular space is defined between the inlet valve body 67 and the wall defining the through hole 62.

An outlet valve chamber 70 is defined between the upper portion 61*a* and the cap 61*b*. A circumferential wall and a bottom of the outlet valve chamber 70 are defined by the upper portion 61*a*. The upper end of the through hole 62 opens to the outlet valve chamber 70 and defines a valve hole 62*a*. The upper surface of the upper portion 61*a,* in which the valve hole 62*a* is formed, functions as a valve seat 71. The diameter of the valve hole 62*a* is smaller than that of the separator 65 and larger than that of the distal portion 64.

Ports 73 are formed in the circumferential wall of the cap 61*b*. The ports 73 connect the outlet valve chamber 70 with the downstream bleed section 41*b* of the bleed passage 41. The outlet valve chamber 70 is exposed to the pressure in the suction chamber 34 (suction pressure Ps) through the downstream bleed section 41*b* and the ports 73. The upper portion 61*a* has ports 74. The ports 74 connect a portion of the through hole 62 above the separator 65 to the upstream bleed section 41*a* of the bleed passage 41. The interior of the valve hole 62*a* is exposed to the pressure in the crank chamber 15 (crank pressure Pc) through the upstream bleed section 41*a* and the ports 74. The ports 73, 74, the portion of the through hole 62 above the separator 65, and the outlet valve chamber 70 form part of the bleed passage 41 within the control valve 60.

A pressure sensing member, which is a bellows 75 in this embodiment, and an outlet valve body 76 are located in the outlet valve chamber 70. The interior of the bellows 75 is under vacuum, or low-pressure. A stationary end of the bellows 75 is fixed to the inner wall of the cap 61*b*. A spring 77 is located in the bellows 75. The spring 77 urges a movable end of the bellows 75 downward. The bellows 75 is moved axially in accordance with the suction pressure Ps in the outlet valve chamber 70.

The outlet valve body 76 is coupled to the movable end of the bellows 75 to be axially movable relative to the movable end. The outlet valve body 76 slidably contacts the inner wall of the outlet valve chamber 70 and divides the outlet valve chamber 70 into an upper zone and a lower zone. The outlet valve body 76 contacts and separates from the valve seat 71. For convenience of description, a position of the outlet valve body 76 when it contacts the valve seat 71 will be referred to as the closed position, and a position of the outlet valve body 76 when it is separated from the valve seat 71 will be referred to as the open position.

The outlet valve body 76 has through holes 78 to communicate the upper zone and the lower zone in the outlet valve chamber 70. Further, the outlet valve body 76 has a passage 79, which is connected to the through holes 78 and opens to face the valve hole 62*a*. When the outlet valve body 76 contacts the valve seat 71, the valve hole 62*a* is communicated with the outlet valve chamber 70 through the passage 79 and the through holes 78. Therefore, when the outlet valve body 76 is in the closed position, the crank chamber 15 is connected to the suction chamber 34 through the bleed passage 41.

In this specification, regardless of whether the valve hole 62*a* is connected to the outlet valve chamber 70 through the passage 79, the closed state of the outlet valve mechanism V1 refers to a state in which the outlet valve body 76 contacts the valve seat 71, and the open state of the outlet valve mechanism V1 refers a state in which the outlet valve body 76 is separated from the valve seat 71. Hereinafter, the opening degree of the outlet valve mechanism V1 will refer to the size of the space between the outlet valve body 76 and the valve seat 71.

The outlet valve body 76 is urged toward the valve seat 71 by a coil spring 80 located in the outlet valve chamber 70. The coil spring 80 holds the outlet valve body 76 against the valve seat 71 unless the transmission rod 63 moves the valve body 76 upward. However, when the pressure difference between the crank pressure Pc acting on the outlet valve body 76 and the suction pressure Ps acting on the outlet valve body 76 is relatively high, the outlet valve body 76 separates from the valve seat 71 against the force of the springs 77 and 80. The outlet valve mechanism V1 functions as a differential valve, which is actuated in accordance with the difference between the crank pressure Pc and the suction pressure Ps.

The inlet valve mechanism V2 will now be described. The inlet valve mechanism V2 has an inlet valve chamber 81 defined between the upper portion 61*a* and the lower portion 61*c*. The lower end of the through hole 62 opens to the inlet valve chamber 81 and forms a valve hole 62*b*.

The upper portion 61*a* has ports 82, which connect the inlet valve chamber 81 with the downstream supply section 42*b* of the supply passage 42. The upper portion 61*a* also has ports 83, which connect a part of the through hole 62 that is below the separator 65 to the upstream supply section 42*a* of the supply passage 42. The ports 82, 83, the part of the through hole 62 below the separator 65, and the inlet valve chamber 81 form a part of the supply passage 42 that is in the control valve 60.

The inlet valve body 67 is located in the inlet valve chamber 81. The inlet valve body 67 is moved between a position entering the valve hole 62*b* and a position separated from the valve hole 62*b*. For convenience of description, a position of the inlet valve body 67 when it enters the valve hole 62*b* will be referred to as the restricted position, and a position of the inlet valve body 67 when it separates from the valve hole 62*b* will be referred to as the open position. When the inlet valve body 67 enters the valve hole 62*b*, a small annular space is defined between the inlet valve body 67 and the valve hole 62*b*. Thus, when the inlet valve body 67 is at the restricted position, the crank chamber 15 is connected with the discharge chamber 35 through the supply passage 42 by a small space.

In this specification, the restricted state of the inlet valve mechanism V2 is a state in which the inlet valve body 67 enters the valve hole 62*b*, and the open state of the inlet valve mechanism V2 is a state in which the inlet valve body 67 is separated from the valve hole 62*b*. When the inlet valve mechanism V2 is in the restricted state, the opening degree of the inlet valve mechanism V2 is not necessary zero.

The electromagnetic solenoid V3, or the electromagnetic actuator, is located in the lower portion 61*c*. The solenoid V3 has a cup-shaped accommodating cylinder 84 located in the lower portion 61*c*. A fixed iron core 85 is fitted in the upper opening of the cylinder 84. A movable iron core 86 is housed in the cylinder 84 to move axially. The second coupler 68 of the transmission rod 63 extends through and moves axially relative to the fixed core 85. The movable core 86 is fixed to the lower end of the second coupler 68. A return spring 87 extends between the fixed core 85 and the movable core 86. The return spring 87 urges the movable core 86 away from the fixed core 85.

An exciting coil 88 is located about the cylinder 84. When the drive circuit 53 supplies a current to the coil 88, an electromagnetic attraction force is generated between the movable core 86 and the fixed core 85. The magnitude of the attraction force corresponds to the value of the current supplied to the coil 88. The value of the supplied current represents the target value of the suction pressure (target suction pressure). When no current is supplied to the coil, the return spring 87 moves the rod 63 to a predetermined initial position (the position shown in FIG. 2) through the movable core 86.

When the rod 63 is at the initial position, the distal portion 64 of the rod 63 is spaced apart from the lower face of the outlet valve body 76 by a predetermined distance. Thus, the outlet valve body 76 is at the closed position and the inlet valve body 67 is at an open position to maximize the opening size of the valve hole 62*b*. At this time, the distal portion 64 is separated from the passage 79 formed in the outlet valve body 76, which connects the crank chamber 15 with the suction chamber 34 through the bleed passage 41.

Figure 4:
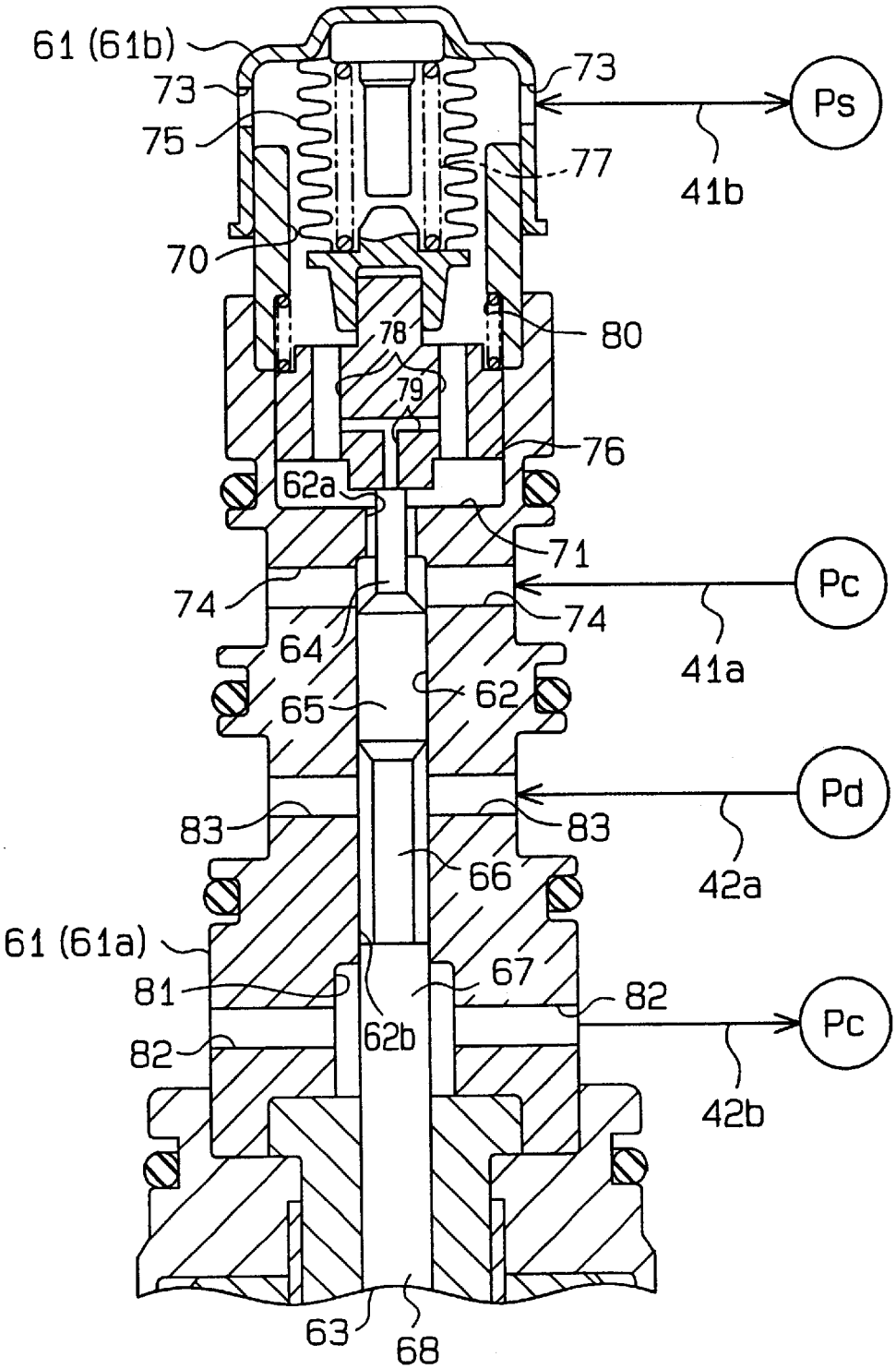
FIG. 4 is an enlarged partial cross-sectional view illustrating the displacement control valve of FIG. 2.

When a current is supplied to the solenoid V3, the rod 63 is urged upward by a force, the magnitude of which corresponds to the value of the supplied current. When the inlet valve body 67 enters the valve hole 62*b*, as shown in FIG. 4, the distal portion 64 raises the outlet valve body 76 away from the valve seat 71. At this time, the distal portion 64 closes the passage 79 of the outlet valve body 76. The space between the outlet valve body 76 and the valve seat 71, or the opening degree of the outlet valve mechanism V1, is mainly determined by the force applied to the rod 63 by the solenoid V3 and the force of the bellows 75. The outlet valve mechanism V1 operates in accordance with the suction pressure Ps in the outlet valve chamber 70 such that the suction pressure Ps is directed to the target suction pressure set by the solenoid V3.

When the outlet valve body 76 is at the farthest position from the valve seat 71, that is, when the opening degree of the outlet valve mechanism V1 is maximized, the flow rate of refrigerant gas between the outlet valve body 76 and the valve seat 71 in the bleed passage 41 is set to a gas flow of 100%. If the outlet valve body 76 contacts the valve seat 71 and the rod 63 separates from the outlet valve body 76, the flow rate of refrigerant gas through the passage 79 in the bleed passage 41 is ten to thirty percent.

Figure 3:
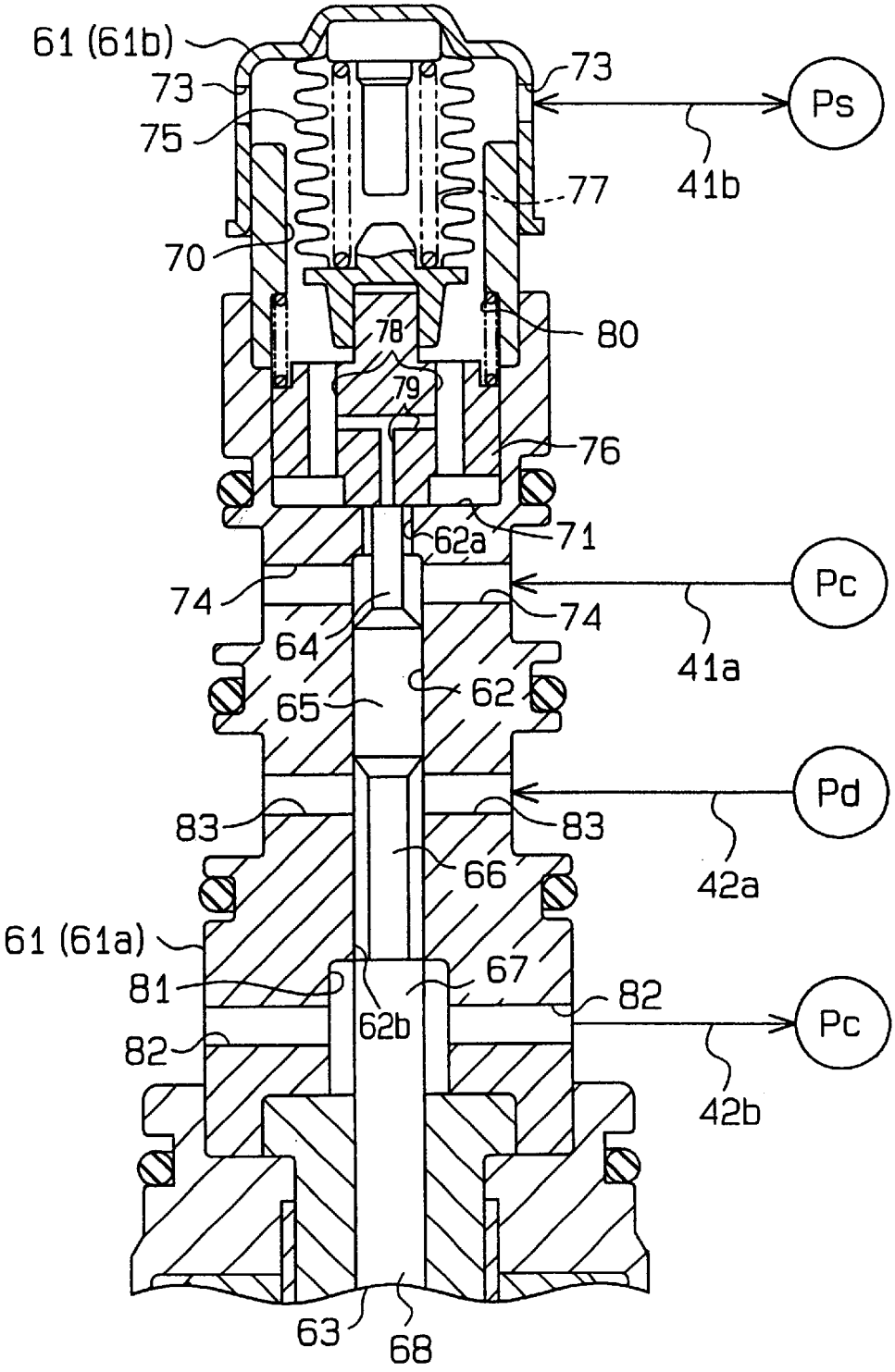
FIG. 3 is an enlarged partial cross-sectional view illustrating the displacement control valve of FIG. 2.

When the value of current supplied to the solenoid V3 is relatively small, the rod 63 contacts the outlet valve body 76 without separating the outlet valve body 76 from the valve seat 71, as shown in FIG. 3. At this time, the upper end of the inlet valve body 67 is substantially at the same position as the opening end of the valve hole 62*b*. Therefore, the bleed passage 41 is completely closed, and the inlet valve mechanism V2 is substantially in the restricted state.

Figure 5:
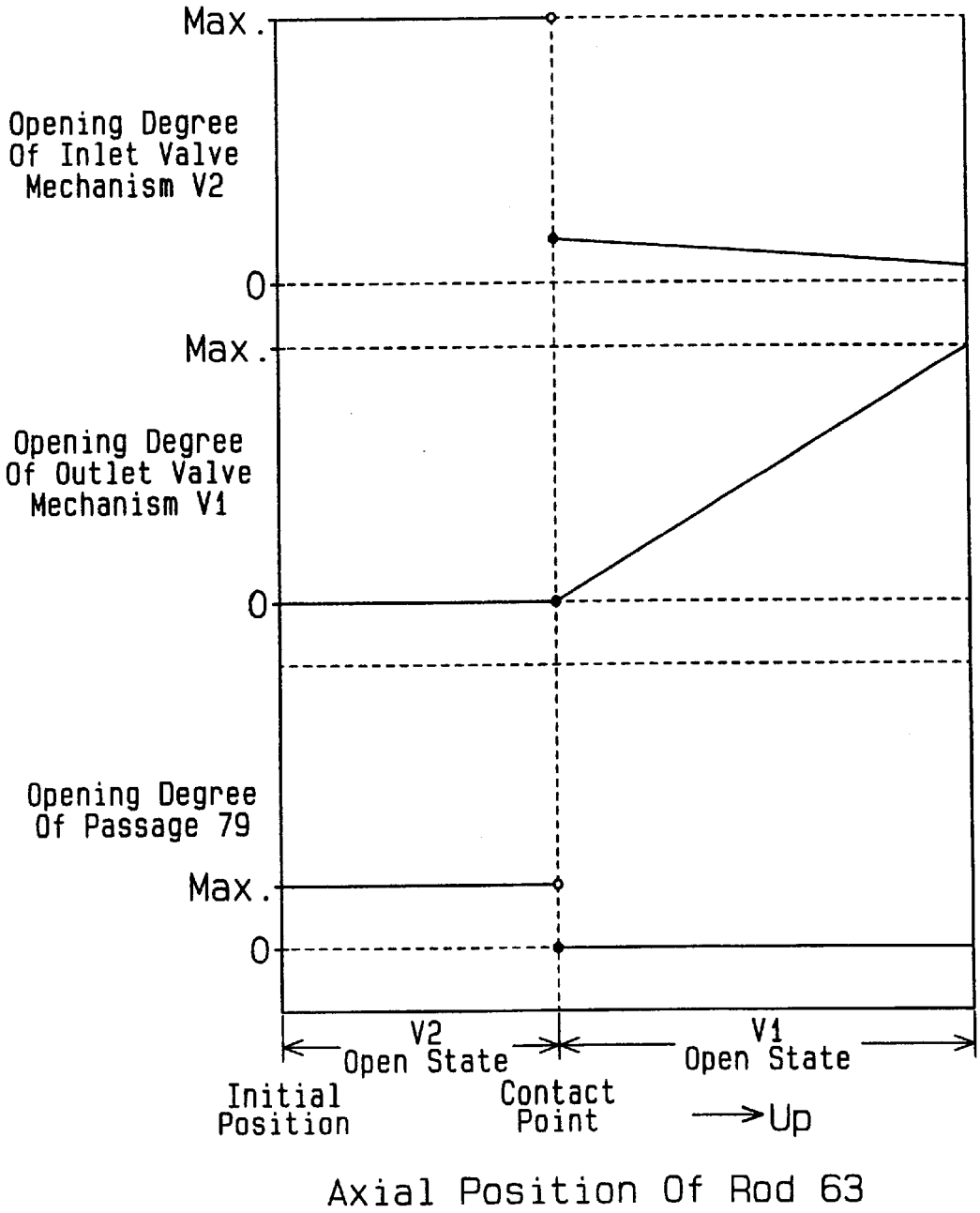
FIG. 5 is a graph showing the operational characteristics of the control valve shown in FIG. 2.

FIG. 5 is a graph showing the characteristics of the control valve 60. Specifically, the graph shows the opening degree of the inlet valve mechanism V2, the opening degree of the outlet valve mechanism V1 and the opening degree of the passage 79 in relation with the axial position of the rod 63.

When no current is supplied to the solenoid V3 and the rod 63 is at its initial position (see FIG. 2), the opening degree of the inlet valve mechanism V2 is maximized, the opening degree of the inlet valve mechanism V1 is zero, and the opening degree of the passage 79 is maximized.

When a current is supplied to the solenoid V3, the solenoid V3 urges the rod 63 toward the outlet valve body 76 by a force the magnitude of which corresponds to the value of the supplied current. When the rod 63 contacts the outlet valve body 76 as shown in FIG. 3 (contact point in FIG. 5), the opening degree of the outlet valve mechanism V1 is zero and the opening degree of the passage 79 is also zero. At this time, the inlet valve mechanism V2 is in the restricted state. Since there is a small space between the inlet valve body 67 and the valve hole 62*b*, the opening degree of the inlet valve mechanism V2 is slightly greater than zero.

As the rod 63 moves the outlet valve body 76 upward, the opening degree of the outlet valve mechanism V1 changes from zero to maximum. At this time, the opening degree of the passage 79 is maintained at zero. When the rod 63 moves the outlet valve body 76 upward, the inlet valve body 67 enters the valve hole 62*b*, which keeps the inlet valve mechanism V2 in the restricted state. As the inlet valve body 67 further enters the valve hole 62*b*, the space between the inlet valve body 67 and the valve hole 62*b* permits less gas to flow therethrough, which gradually decreases the opening degree of the inlet valve mechanism V2.

The operation of the compressor 10 will now be described. When the compressor is stopped for a relatively long period, the suction pressure Ps in the suction chamber 34, the discharge pressure Pd in the discharge chamber 35 and the crank pressure Pc in the crank chamber 15 are equalized and the swash plate 25 is retained at the minimum inclination position by the spring 29.

When the engine E is running and the air conditioner switch 51 is off, no current is supplied to the coil 88 of the control valve 60. Therefore, as shown in FIG. 2, the rod 63 is moved to the initial position. Accordingly, the outlet valve mechanism V1 is in the closed state and the inlet valve mechanism V2 is in the open state. In this state, the passage 79 of the outlet valve body 76 is open. However, the flow rate of refrigerant gas through the passage 79 is less than the flow rate of refrigerant gas through the inlet valve mechanism V2, which is in the open state. Thus, the flow rate of refrigerant gas entering the crank chamber 15 is more than the flow rate of refrigerant gas being discharged from the crank chamber 15, which increases the crank pressure Pc. Accordingly, the inclination angle of the swash plate 25 and the compressor displacement are minimized.

When at the minimum inclination position, the swash plate 25 causes each piston 32 to reciprocate at the minimum stroke. At this time, the check valve mechanism 54 is closed. Therefore, refrigerant gas discharged to the discharge chamber 35 from the cylinder bores 31 does not flow to the refrigerant circuit 43 but is supplied to the crank chamber 15 through the opened supply passage 42. Although the outlet valve mechanism V1 is closed, the passage 79 is open. Thus, refrigerant gas in the crank chamber 15 is released to the suction chamber 34 through the passage 79 and is then drawn into the cylinder bores 31. That is, when the compressor is operating at the minimum displacement, a gas circuit is formed within the compressor. The gas circuit includes the cylinder bores 31, the discharge chamber 35, the supply passage 42, the crank chamber 15, the bleed passage 41 (the passage 79) and the suction chamber 34. The refrigerant gas contains atomized oil. The oil is circulated in the gas circuit with the circulation of refrigerant gas and lubricates the moving parts of the compressor. The passage 79 functions as part of the gas circuit when the outlet valve mechanism V1 is closed.

If the starting switch 51 is turned on and the temperature detected by the temperature sensor 49 is higher than a target temperature set by the temperature adjuster 50 while the engine E is running, the controller C supplies a current, the value of which corresponds to the temperature difference, to the coil 88 of the control valve 60. This sets the inlet valve mechanism V2 to the restricted state and the outlet valve mechanism V1 to the open state. At this time, the rod 63 closes the passage 79. The opening degree of the inlet valve mechanism V2 is not zero when the mechanism V2 is in the restricted state. Thus, a small amount of refrigerant gas is supplied to the crank chamber 15 from the discharge chamber 35 to the crank chamber 15 through the supply passage 42. The outlet valve mechanism V1, which is in the open state, permits gas to flow from the crank chamber 15 to the suction chamber 34 through the bleed passage 41.

If the thermal load on the refrigeration circuit increases, the pressure at the outlet of the evaporator 46 increases, which raises the suction pressure Ps. Also, the difference between the compartment temperature and the target temperature increases. The controller C increases the value of a current supplied to the coil 88 so that the difference between the compartment temperature and the target temperature is eliminated. Accordingly, the attraction force between the fixed core 85 and the movable core 86 is increased, which increases the force urging the outlet valve body 76 away from the valve seat 71. Therefore the target suction pressure is set at a lower value. The bellows 75 causes the outlet valve body 76 to adjust the opening size of the valve hole 62*a* such that the actual suction pressure Ps is directed to the lower target suction pressure. That is, the greater the supplied current value to the coil 88 is, the lower the suction pressure level that is set by the control valve 60 is.

If the actual suction pressure Ps is higher than the target suction pressure, the bellows 75 causes the outlet valve body 76 to increase the opening size of the valve hole 62*a*. Then, the flow rate of the refrigerant gas discharged to the suction chamber 34 from the crank chamber 15 through the bleed passage 41 increases, and the crank pressure Pc decreases. Thus, the inclination angle of the swash plate 25 increases and the displacement of the compressor increases. The increase in the compressor displacement increases the cooling performance of the refrigeration circuit and decreases the actual suction pressure Ps. Thus, the actual suction pressure Ps seeks the target suction pressure.

Part of the through hole 62 between the inlet valve body 67 and the separator 65 is exposed to the discharge pressure Pd of the discharge chamber 35 through the upstream supply section 42*a* of the supply passage 42. The discharge pressure Pd urges the inlet valve body 67 downward and urges the separator 65 upward. Thus, the force of the discharge pressure Pd acting on the rod 63 is substantially cancelled. The discharge pressure Pd therefore does not affect the motion of the rod 63, which optimizes the operation of the valve mechanisms V1, V2.

If the thermal load on the refrigeration circuit decreases, the pressure at the outlet of the evaporator 46 decreases, which lowers the suction pressure Ps. Also, the difference between the compartment temperature and the target temperature decreases. The controller C decreases the value of the current supplied to the coil 88. Accordingly, the attraction force between the fixed core 85 and the movable core 86 is decreased, which decreases the force urging the outlet valve body 76 away from the valve seat 71. Therefore the target suction pressure is set at a higher value. The bellows 75 causes the outlet valve body 76 to adjust the opening size of the valve hole 62*a* such that the actual suction pressure Ps is directed to the higher target suction pressure. That is, the smaller the supplied current value to the coil 88 is, the higher the suction pressure level that is set by the control valve 60 is.

If the actual suction pressure Ps is lower than the target suction pressure, the bellows 75 causes the outlet valve body 76 to decrease the opening size of the valve hole 62*a*. Then, the flow rate of the refrigerant gas discharged to the suction chamber 34 from the crank chamber 15 through the bleed passage 41 decreases, and the crank pressure Pc increases. Thus, the inclination angle of the swash plate 25 is decreased and the displacement of the compressor is decreased. The decrease in the compressor displacement decreases the cooling performance of the refrigeration circuit and increases the actual suction pressure. Thus, the actual suction pressure seeks the target suction pressure.

When the compressor displacement is controlled in accordance with the thermal load in the above described manner, a current that at least causes the rod 63 to contact the outlet valve body 76 is supplied to the solenoid V3. Therefore, with the passage 79 closed, the opening degree of the outlet valve mechanism V1 may be set to any degree between zero and the maximum opening degree (see FIG. 5). In other words, the flow rate of gas from the crank chamber 15 to the suction chamber 34 may be adjusted, without being influenced by the passage 79, from zero to the maximum value according only to the size of the space between the outlet valve body 76 and the valve seat 71.

When the switch 51 is turned off or when the temperature of the evaporator 46 drops to a frost forming temperature while the engine E is running, the controller C stops current to the solenoid V3. Also, if the ECU 52 commands the controller C to minimize the compressor displacement (when the load on a vehicle engine increases, for example, when the vehicle is rapidly accelerated), the controller C temporarily stops current to the solenoid V3. In this case, the rod 63 is returned to the initial position by the return spring 87, which sets the outlet valve mechanism V1 to the closed state and the inlet valve mechanism V2 to the open state. As a result, highly pressurized gas is quickly supplied from the discharge chamber 35 to the crank chamber 15 and the crank pressure Pc increases. This quickly minimizes the inclination angle of the swash plate 25 and the compressor displacement.

The control valve 60 of the first embodiment has the following advantages.

The outlet valve mechanism V1 includes the passage 79. The passage 79 permits gas to flow from the crank chamber 15 to the suction chamber 34 when the outlet valve mechanism V1 is in the closed state and the inlet valve mechanism V2 is in the open state. Therefore, when the compressor displacement is minimum, the gas circuit is formed within the compressor 10 through the control valve 60, which lubricates the moving parts of the compressor 10. Thus, the control valve 60 is suitable for clutchless compressors. Also, an auxiliary passage, other than the bleed passage 41, need not be formed in the compressor housing to connect the crank chamber 15 to the suction chamber 34.

When the outlet valve mechanism V1 is in the open state, the passage 79 is closed. Only when the inlet valve mechanism V2 is in the open state, the passage 79 functions to form the gas circuit within the compressor 10. When the outlet valve mechanism V1 performs its primary function, that is, when the outlet valve mechanism V1 controls the opening degree of the bleed passage 41, the passage 79 is closed. Thus, the opening degree of the bleed passage 41 is not prevented from being controlled from zero the maximum degree.

While being urged by the rod 63, the outlet valve body 76 is moved by the bellows 75, which is actuated by the suction pressure Ps. If the rod 63 separates from the outlet valve body 76, the outlet valve body 76 is maintained at the closed position and contacts the valve seat 71.

When the inlet valve mechanism V2 is switched from the restricted state to the open state, the opening degree of the outlet valve mechanism V1 and the opening degree of the passage 79 are temporarily set to zero. Therefore, when the crank pressure Pc is increased by increasing the opening degree of the inlet valve mechanism V2, refrigerant gas is prevented from escaping from the crank chamber 15 through the bleed passage as much as possible, which quickly increases the crank pressure Pc.

When current is not supplied to the solenoid V3, the compressor displacement is minimized. Therefore, when current to the solenoid V3 is stopped unintentionally, the displacement is minimized and the compressor torque is minimized. This prevents the compressor from operating at the maximum displacement in an uncontrollable state.

The bleed passage 41 and the supply passage 42 are independent from each other. Therefore, the gas circuit, which includes the cylinder bores 31, the discharge chamber 35, the supply passage 42, the crank chamber 15, the bleed passage 41 and the suction chamber 34, is positively formed within the compressor 10.

Figure 6:
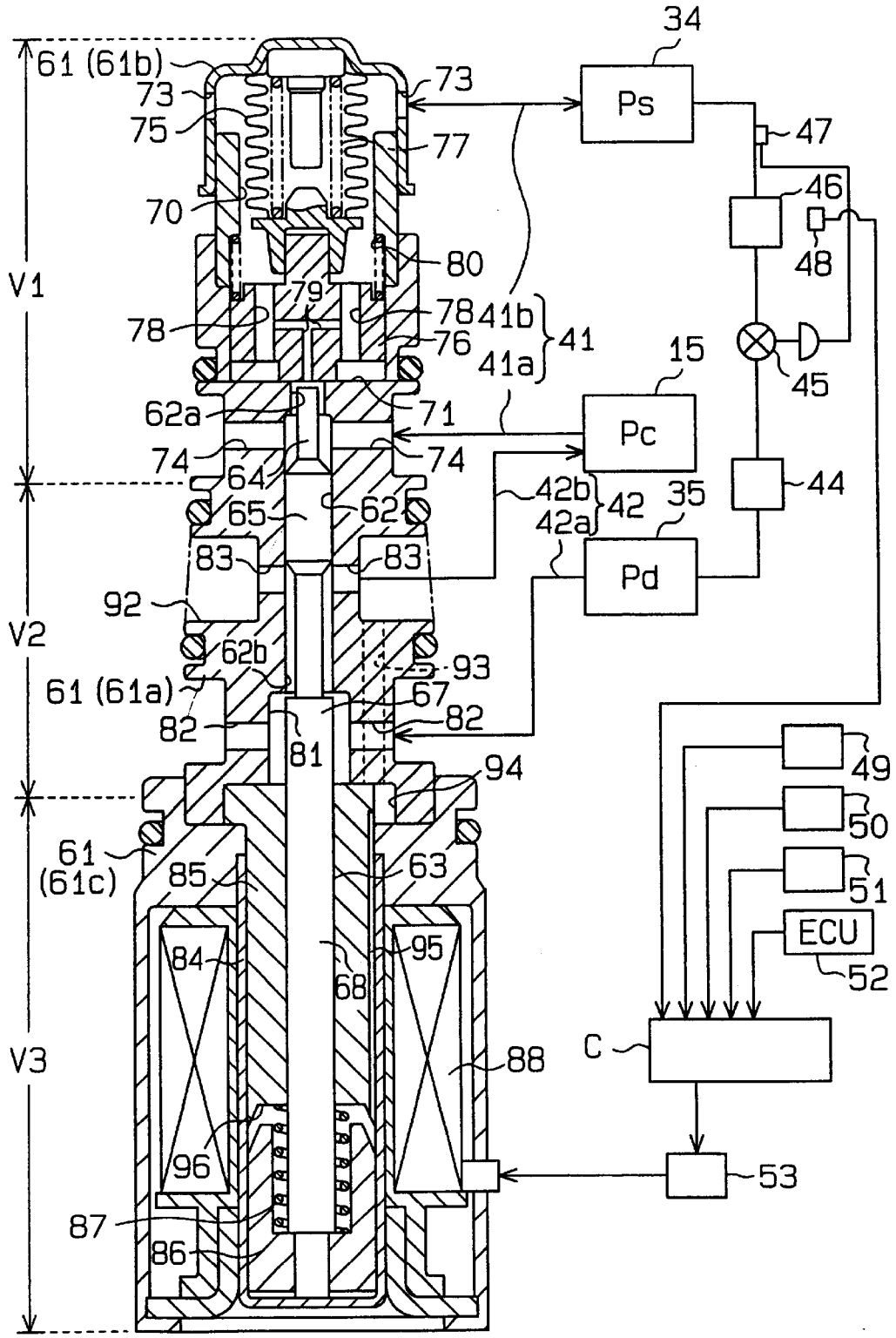
FIG. 6 is a cross-sectional view illustrating a displacement control valve according to a second embodiment of the present invention.

A second embodiment of the present invention will be described with reference to FIG. 6. Mainly, the differences from the embodiment of FIGS. 1 to 5 will be discussed below. Unlike the embodiment of FIGS. 1 to 5, the ports 82 of FIG. 6 are connected to the upstream supply section 42*a* of the supply passage 42, and the ports 83 are connected to the downstream supply section 42*b* of the supply passage 42. Thus, the discharge pressure Pd is applied to the inlet valve chamber 81 through the upstream supply section 42*a* of the supply passage 42 and the port 82. The crank pressure Pc is applied to part of the through hole 62 below the separator 65 through the downstream supply section 42*b* of the supply passage 42.

The upper portion 61*a* has an annular groove 92, which corresponds to the ports 83. When the control valve 60 is installed in the rear housing member 14, the groove 92 and a wall of the rear housing member 14 define an annular pressure chamber.

The groove 92 is connected to a plunger chamber 96, which accommodates the movable core 86, through a communication passage 93, a communication chamber 94 and a longitudinal groove 95. The communication passage 93 is formed in the upper portion 61*a*. The communication chamber 94 is defined between the fixed core 85 and the upper portion 61*a*. The longitudinal groove 95 is formed in the surface of the fixed core 85. Therefore, like the part of the through hole 62 below the separator 65, the plunger chamber 96 is exposed to the crank pressure Pc.

Part of the through hole 62 between the inlet valve body 67 and the separator 65 is exposed to the discharge pressure Pd of the discharge chamber 35 through the upstream supply section 42*a* of the supply passage 42. The discharge pressure urges the inlet valve body 67 downward and urges the separator 65 upward. Therefore, the discharge pressure Pd acting on the rod 63 is substantially cancelled. Thus, the discharge pressure Pd does not influence the motion of the rod 63, which optimizes the operation of the valve mechanisms V1 and V2.

When the inlet valve body 67 enters the valve hole 62*b*, the pressure in the part of the through hole 62 between the inlet valve body 67 and the separator 65 and the pressure in the plunger chamber 96 are equalized with the crank pressure Pc. Therefore, the force based on the crank pressure Pc, which urges the inlet valve body 67 downward, and the force based on the crank pressure Pc, which urges the lower portion of the rod 63 upward, cancel each other. The separator 65 receives opposite forces based on the crank pressure Pc at its upper and lower surfaces, and the forces cancel each other. Therefore, the crank pressure Pc does not influence the motion of the rod 63, which optimizes the operation of the valve mechanisms V1 and V2.

The present invention may be embodied in the following forms.

The upstream bleed section 41*a* of the bleed passage 41 and the downstream supply section 42*b* of the supply passage 42 may form a common passage. In this case, the ports 74, 83 may be replaced by a common set of ports and the separator 65 may be omitted from the rod 63.

The pressure sensing member of the outlet valve mechanism V1 may be a diaphragm instead of the bellows 75.

When the inlet valve mechanism V2 is in the restricted state, a space need not exist between the inlet valve body 67 and the valve hole 62*b*. That is, the restricted state of the inlet valve mechanism V2 includes a state in which the valve hole 62*b* is completely closed. In this case, an auxiliary supply passage, which bypasses the control valve 60, may be formed for continuously connecting the discharge chamber 35 with the crank chamber 15.

The present invention may be embodied in compressors other than the swash plate type compressor. For example, the present invention may be embodied in a wobble plate type compressor. In a wobble plate type compressor, when a drive shaft rotates, the wobble plate, which is coupled to pistons, wobbles without being rotated.

The present examples and embodiments are to be considered as illustrative and not restrictive and the invention is not to be limited to the details given herein, but may be modified within the scope and equivalence of the appended claims.

What is claimed is:

1. A control valve for a variable displacement compressor, the displacement of which varies in accordance with the pressure in a crank chamber, wherein the compressor includes a suction pressure zone, the pressure of which is a suction pressure, a discharge pressure zone, the pressure of which is a discharge pressure, a bleed passage for releasing gas from the crank chamber to the suction pressure zone, and a supply passage for supplying gas from the discharge pressure zone to the crank chamber, the control valve comprising:

an outlet valve mechanism located in the bleed passage to adjust the opening degree of the bleed passage;

an inlet valve mechanism located in the supply passage to adjust the opening degree of the supply passage;

a transmission member extending between the outlet valve mechanism and the inlet valve mechanism to couple the outlet valve mechanism with the inlet valve mechanism, wherein the transmission member moves axially, and wherein, when the inlet valve mechanism is in an open state, the outlet valve mechanism is in a closed state;

an electromagnetic actuator, wherein the actuator axially urges the transmission member by a force, the magnitude of which corresponds to the value of a current supplied to the actuator; and a communication passage formed in the outlet valve mechanism, wherein, when the outlet valve mechanism is in the closed state, the communication passage may be opened, depending on the axial position of the transmission member, for communicating the crank chamber with the suction pressure zone.

2. The control valve according to claim 1, wherein, when the outlet valve mechanism is set to an open state, the communication passage is closed.

3. The control valve according to claim 1, wherein the outlet valve mechanism includes a valve hole formed in the bleed passage and an outlet valve body facing the valve hole, wherein the communication passage is formed in the outlet valve body and opens to the valve hole, wherein the transmission member selectively engages with and disengages from the outlet valve body, and wherein, when engaging with the outlet valve body, the transmission member shuts the communication passage, and when disengaging from the outlet valve body, the transmission member opens the communication passage.

4. The control valve according to claim 3, wherein, when a current having a certain value is supplied to the electromagnetic actuator, the transmission member sets the inlet valve mechanism to a restricted state and engages the outlet valve body and urges the outlet valve body away from the valve hole.

5. The control valve according to claim 3, wherein, when no current is supplied to the electromagnetic actuator, the transmission member sets the inlet valve mechanism to the open state and disengages from the outlet valve body, and wherein, when the transmission member disengages from the outlet valve body, the outlet valve body shuts the valve hole, and the communication passage is open to the valve hole.

6. The control valve according to claim 5, further including an urging member, wherein the urging member urges the transmission member in a direction opposite to the direction of the force applied to the transmission member by the electromagnetic actuator.

7. The control valve according to claim 3, wherein, when the transmission member is at a predetermined axial position, the transmission member contacts the outlet valve body while the outlet valve body shuts the valve hole.

8. The control valve according to claim 3, wherein the outlet valve mechanism includes an outlet valve chamber, which is connected to the suction pressure zone through a downstream section of the bleed passage, and a pressure sensing member accommodated in the outlet valve chamber, wherein the pressure sensing member moves the outlet valve body in accordance with the pressure in the outlet valve chamber.

9. The control valve according to claim 1, further including an urging member, wherein the urging member urges the transmission member in a direction opposite to the direction of the force applied to the transmission member by the electromagnetic actuator, and wherein, when no current is supplied to the electromagnetic actuator, the urging member moves the transmission member such that the inlet valve mechanism is in the open state and the outlet valve mechanism is in the closed state.

10. A control valve for a variable displacement compressor, the displacement of which varies in accordance with the pressure in a crank chamber, wherein the compressor includes a suction pressure zone, the pressure of which is a suction pressure, a discharge pressure zone, the pressure of which is a discharge pressure, a bleed passage for releasing gas from the crank chamber to the suction pressure zone, and a supply passage for supplying gas from the discharge pressure zone to the crank chamber, the control valve comprising:

an outlet valve mechanism located in the bleed passage to adjust the opening degree of the bleed passage, wherein the outlet valve mechanism includes a valve hole formed in the bleed passage and an outlet valve body facing the valve hole, and wherein the bleed passage includes an upstream section, which is located upstream of the outlet valve body, and a downstream section, which is located downstream of the outlet valve body;

an inlet valve mechanism located in the supply passage to adjust the opening degree of the supply passage;

a transmission rod extending between the outlet valve mechanism and the inlet valve mechanism to couple the outlet valve mechanism with the inlet valve mechanism, wherein the transmission rod moves axially to selectively engage with and disengage from the outlet valve body, and wherein, when the inlet valve mechanism is in an open state, the transmission rod is separated from the outlet valve body so that the outlet valve body shuts the valve hole;

an electromagnetic actuator, wherein the actuator axially urges the transmission rod by a force, the magnitude of which corresponds to the value of a current supplied to the actuator; and a communication passage formed in the outlet valve body to communicate the upstream section of the bleed passage with the downstream section of the bleed passage, wherein, when contacting the outlet valve body, the transmission rod shuts the communication passage, and wherein, when disengaging from the outlet valve body, the transmission rod opens the communication passage.

11. The control valve according to claim 10, wherein, when a current having a certain value is supplied to the electromagnetic actuator, the transmission rod sets the inlet valve mechanism to a restricted state and engages the outlet valve body and urges the outlet valve body away from the valve hole.

12. The control valve according to claim 10, wherein, when no current is supplied to the electromagnetic actuator, the transmission rod sets the inlet valve mechanism to the open state and disengages from the outlet valve body.

13. The control valve according to claim 12, further including a spring, wherein the spring urges the transmission rod in a direction opposite to the direction of the force applied to the transmission rod by the electromagnetic actuator.

14. The control valve according to claim 10, wherein the outlet valve mechanism includes an outlet valve chamber, which is connected to the suction pressure zone through the downstream section of the bleed passage, and a pressure sensing member accommodated in the outlet valve chamber, wherein the pressure sensing member moves the outlet valve body in accordance with the pressure in the outlet valve chamber.

15. A variable displacement compressor, which varies the displacement in accordance with the pressure in a crank chamber, wherein the compressor comprises:

a suction pressure zone, the pressure of which is a suction pressure;

a discharge pressure zone, the pressure of which is a discharge pressure;

a bleed passage for releasing gas from the crank chamber to the suction pressure zone;

a supply passage for supplying gas from the discharge pressure zone to the crank chamber, wherein the supply passage is formed independently from the bleed passage; and a control valve for controlling the pressure in the crank chamber, wherein the control valve includes:

an outlet valve mechanism located in the bleed passage to adjust the opening degree of the bleed passage;

an inlet valve mechanism located in the supply passage to adjust the opening degree of the supply passage;

a transmission member extending between the outlet valve mechanism and the inlet valve mechanism to couple the outlet valve mechanism with the inlet valve mechanism, wherein the transmission member moves axially, and wherein, when the inlet valve mechanism is in an open state, the outlet valve mechanism is in a closed state;

an electromagnetic actuator, wherein the actuator axially urges the transmission member by a force, the magnitude of which corresponds to the value of a current supplied to the actuator; and a communication passage formed in the outlet valve mechanism, wherein, when the outlet valve mechanism is in the closed state, the communication passage may be opened, depending on the axial position of the transmission member, for communicating the crank chamber with the suction pressure zone.

16. The compressor according to claim 15, wherein the discharge pressure zone is connected to the suction pressure zone through an external refrigerant circuit, wherein a check valve is located between the external refrigerant circuit and the discharge pressure zone to prevent gas from flowing from the external refrigerant circuit to the discharge pressure zone, and wherein, when the displacement of the compressor is minimum, the check valve prevents gas from flowing from the discharge pressure zone to the external refrigerant circuit.

17. The compressor according to claim 15, wherein the compressor is directly coupled to an external drive source for driving the compressor.

* * * * *